United States Patent [19]

Yamamoto et al.

[11] Patent Number: 4,556,099

[45] Date of Patent: Dec. 3, 1985

[54] ABNORMALITY DETECTION AND TYPE DISCRIMINATION IN CONTINUOUS CASTING OPERATIONS

[75] Inventors: Toshiki Yamamoto; Yukio Kiriu; Akira Tsuneoka; Kunikane Sudo, all of Oita, Japan

[73] Assignee: Nippon Steel Corporation, Tokyo, Japan

[21] Appl. No.: 337,363

[22] Filed: Jan. 6, 1982

[30] Foreign Application Priority Data

Jan. 8, 1981 [JP] Japan ..... 56-1422

[51] Int. Cl.[4] ..... B22D 11/04; B22D 11/16

[52] U.S. Cl. ..... 164/451; 164/150; 164/155; 164/413; 164/453; 164/454

[58] Field of Search ..... 164/453, 454, 155, 413, 164/451, 150

[56] References Cited

U.S. PATENT DOCUMENTS

| | | | |
|---|---|---|---|
| 3,204,460 | 9/1965 | Milnes | 164/413 X |
| 3,478,808 | 11/1969 | Adams | 164/453 X |
| 3,537,505 | 11/1970 | Thalmann et al. | 164/453 |
| 3,575,230 | 4/1971 | Calderon | 164/454 |
| 3,786,856 | 1/1974 | Nishikawa | 164/453 |
| 4,066,114 | 1/1978 | Dorr et al. | 164/453 |
| 4,235,276 | 11/1980 | Gilles et al. | 164/454 X |

FOREIGN PATENT DOCUMENTS

| | | | |
|---|---|---|---|
| 2501868 | 7/1976 | Fed. Rep. of Germany . | |
| 2282314 | 3/1976 | France . | |
| 2287040 | 4/1976 | France . | |
| 51-151624 | 12/1976 | Japan . | |
| 55-84259 | 6/1980 | Japan . | |
| 697669 | 9/1953 | United Kingdom | 164/413 |

*Primary Examiner*—Nicholas P. Godici
*Assistant Examiner*—J. Reed Batten, Jr.

[57] ABSTRACT

The abnormality is detected during a flow thereof through the mold. The detection is achieved by means of at least a pair of upper and lower temperature detecting elements, located along the flow of the casting metal. The abnormality is determined to exist when a temperature inversion, that is $T_U \leqq T_L$, takes place. The symbols $T_U$ and $T_L$ denote the temperatures measured by the upper and lower temperature detecting elements, respectively, in which a relationship, that is $T_U > T_L$, stands under a normal casting operation.

7 Claims, 16 Drawing Figures

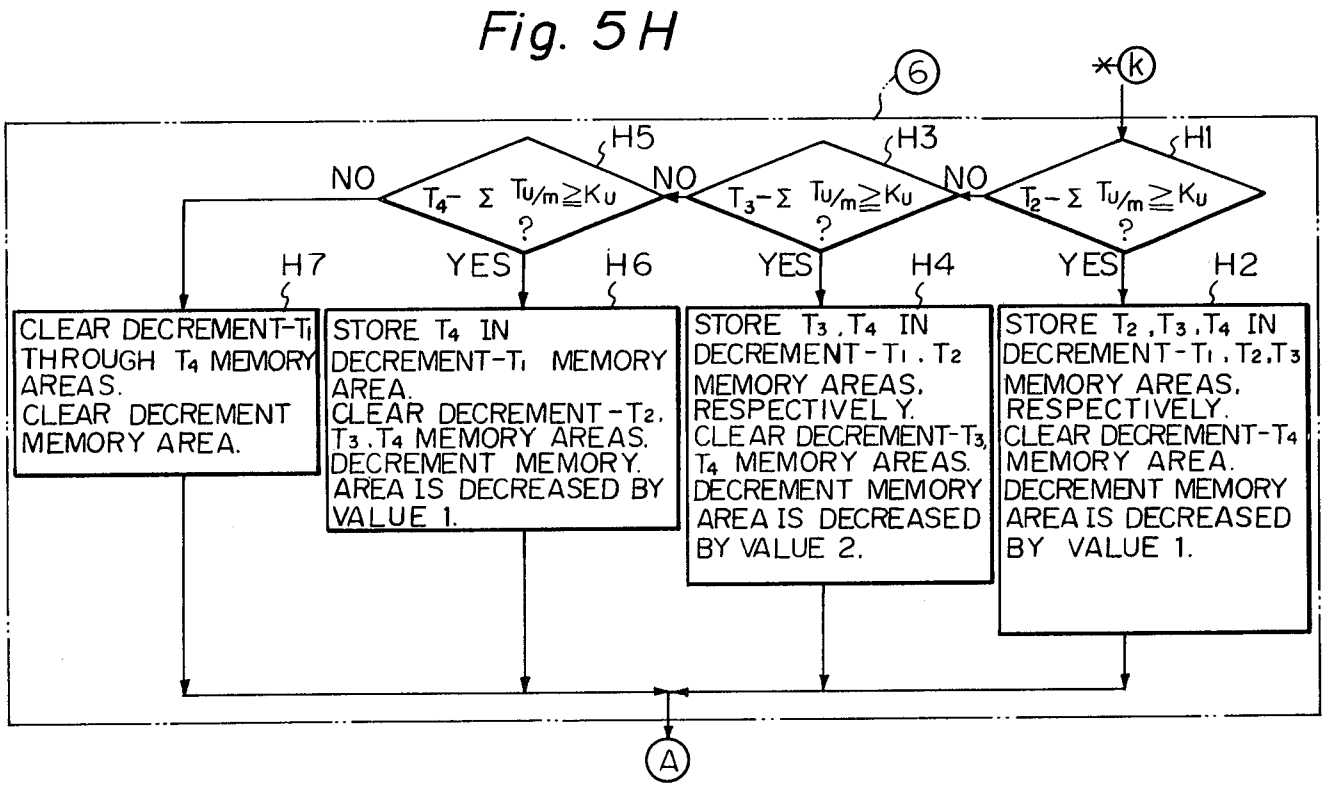
Fig. 5H
*(k)
(6)
H1
$T_2 - \Sigma\ T_{U/m} \geqq K_U$ ?
YES
NO
H2
STORE $T_2$, $T_3$, $T_4$ IN DECREMENT-$T_1$, $T_2$, $T_3$ MEMORY AREAS, RESPECTIVELY. CLEAR DECREMENT-$T_4$ MEMORY AREA. DECREMENT MEMORY AREA IS DECREASED BY VALUE 1.
H3
$T_3 - \Sigma\ T_{U/m} \geqq K_U$ ?
YES
NO
H4
STORE $T_3$, $T_4$ IN DECREMENT-$T_1$, $T_2$ MEMORY AREAS, RESPECTIVELY. CLEAR DECREMENT-$T_3$, $T_4$ MEMORY AREAS. DECREMENT MEMORY AREA IS DECREASED BY VALUE 2.
H5
$T_4 - \Sigma\ T_{U/m} \geqq K_U$ ?
YES
NO
H6
STORE $T_4$ IN DECREMENT-$T_1$ MEMORY AREA. CLEAR DECREMENT-$T_2$, $T_3$, $T_4$ MEMORY AREAS. DECREMENT MEMORY AREA IS DECREASED BY VALUE 1.
H7
CLEAR DECREMENT-$T_1$ THROUGH $T_4$ MEMORY AREAS. CLEAR DECREMENT MEMORY AREA.
(A)

ABNORMALITY DETECTION AND TYPE DISCRIMINATION IN CONTINUOUS CASTING OPERATIONS

BACKGROUND OF THE INVENTION

The present invention relates to continuous casting, more particularly to detection of any abnormality occurring in a casting metal, such as steel flowing through a mold used for continuous casting.

The productivity, safety and maintenance of continuous casting equipment are largely effected by the occurrence of abnormalities, such as a so-called "breakout" which occurs, in a first case, when an opening is formed in a coagulated shell, the solidified shell of the casting liquid metal, (hereinafter referred to as shell, for brevity) of the molten steel in the mold and/or, in a second case, when a large-size impurity particle, made of nonmetal, appears close to the surface of the shell.

According to the conventional art, the temperature is determined, at the shell surface, where the shell has just been drawn out from the mold. If the detected temperature is extremely high, then it is very likely that a breakout may take place during the continuous casting. Therefore, the portion, where the breakout is most likely to occur, is quickly cooled down so as to prevent such a breakout from occurring. However, it is difficult to prevent all such breakouts from occurring. That is, there still exists the possibility that, although the above-mentioned operation for cooling down the temperature is conducted, a breakout may still occur in some portion of the shell. The reason for this is believed to be that, since the temperature is detected at the shell surface which has been drawn out from the mold and the operation for cooling down is applied to suspected areas, it is already too late to prevent a breakout from occurring. Further, it is almost impossible, to prevent the occurrence of a breakout, due to the presence of the large-size particles of the impurity, which is a nonmetal. This is because it is impossible to detect such an impurity particle, appearing near the shell surface, flowing right beneath the surface of the mold, and, accordingly, there has been no method for preventing the occurrence of a breakout.

Contrary to the above, if it is possible to detect an abnormality, which will induce the breakout, when the abnormality is still located inside the mold, then such breakout could be prevented from occurring by the following method. That is, the continuous casting speed could be made considerably slower than usual or the casting could be stopped for a while, so that the molten steel could be sufficiently cooled down and thereby allowed to form a shell having a thickness sufficient to prevent the occurrence of a breakout.

As part of the conventional art, two specific references have been known, i.e., publications of Japanese patent application laid open Nos. 51(1976)-151624 published Dec. 27, 1976 and 55(1980)-84259 published June 25, 1980, respectively. However, as will be mentioned in detail hereinafter, the methods disclosed in these publications have common shortcomings in that, firstly, the methods have no capability for detecting an opening in the shell, which opening is produced when the shell is partially stuck to the inside wall of the mold, and, secondly, the methods are liable to erroneously detect a pseudo opening, that is the detection is not performed with a high degree of accuracy.

SUMMARY OF THE INVENTION

Therefore, it is an object of the present invention to provide a system for detecting an abnormality which may cause a breakout to occur, which system can detect said abnormality with a high degree of accuracy at a time when the casting steel, containing such an abnormality therein, is still flowing inside the mold. In order to attain the above-mentioned object of the present invention, briefly speaking, the temperature T is measured close to the inside wall, that is, it is measured at least at the upper portion and at the lower portion, along the flow of the casting steel, of the inside wall of the mold.

BRIEF DESCRIPTION OF THE DRAWINGS

The present invention will be more apparent from the ensuing description with reference to the accompanying drawings wherein.

DESCRIPTION OF THE PREFERRED EMBODIMENT

According to the previously mentioned first cited references, that is, Japanese patent application laid open No. 51 (1976)-151624, a plurality of temperature detecting elements are arranged longitudinally in the mold. When two adjacent upper and lower temperature detecting elements produce signals indicating that a detected temperature of the upper element is lower by a predetermined value, than that of the lower element and, at the same time, when such a temperature inversion occurs at two portions, simultaneously, an alarm signal is generated, which indicates that an opening of the shell has occurred.

Figure 1:
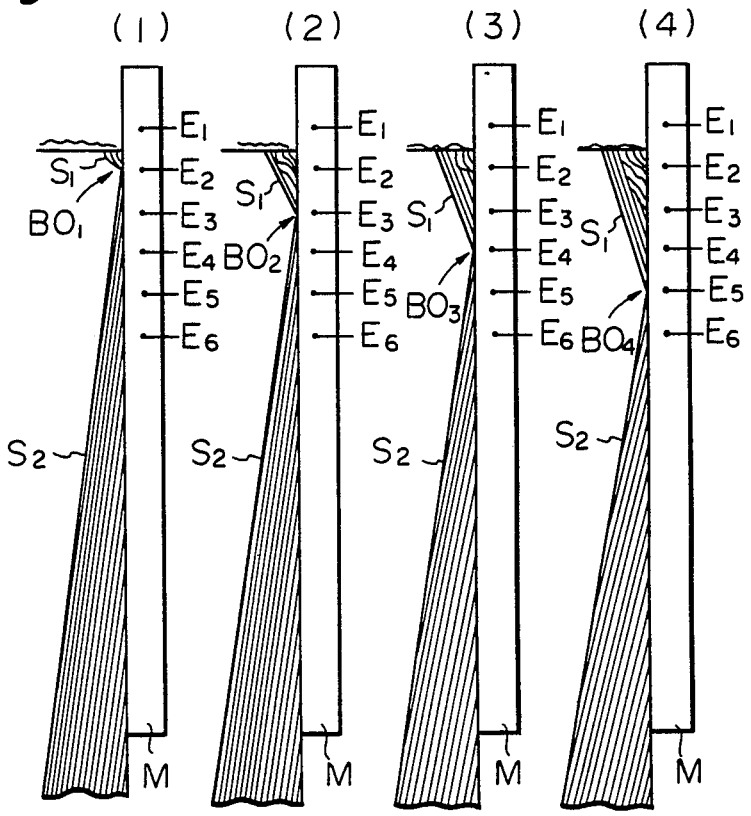
Fig. 1 (PRIOR ART)
FIG. 1 illustrates a set of four cross-sectional views, used for explaining the shortcomings of the cited references.

However, in the first cited reference, if an opening of the shell is detected, which opening is partially stuck to the inside wall of the mold, it is difficult to achieve a correct detection of the opening. The reason for this will be clarified with reference to FIGS. 1 and 2. FIG. 1 illustrates a set of four cross-sectional views, used for explaining the shortcoming of the first reference. In FIG. 1, the reference symbols $S_1$ and $S_2$ represent the shell, the reference symbol M represents the mold, the reference symbols $E_1$ through $E_6$ denote the temperature detecting elements and the reference symbol BO denotes the aforesaid breakout. The numbers (1), (2), (3) and (4) express a sequence of elapsed time (t), that is $t_1 \rightarrow t_2 \rightarrow t_3 \rightarrow t_4$. In FIG. 1, $S_1$ represents a portion of the shell that is stuck to the inside wall of the mold M. $S_2$ represents an ordinary good shell which smoothly slides on the inside wall of the mold M. The stuck shell $S_1$, gradually increases in size, due to the cooling effect of the mold M, as the time elapses, as shown in columns (1)→(2)→(3)→(4). At the same time, the breakout portion BO also is gradually shifted downward, as depicted by the symbols $BO_1 \rightarrow BO_2 \rightarrow BO_3 \rightarrow BO_4$.

Figure 2:
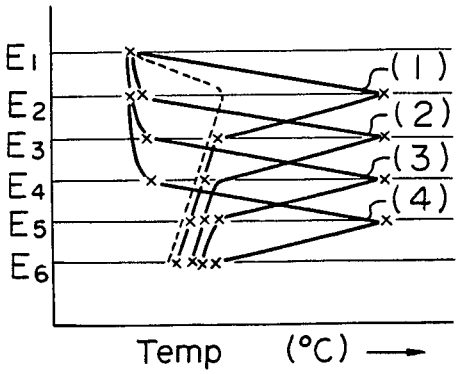
FIG. 2 depicts a graph indicating the relationship between the value of the temperature Temp (°C) and the positions of the temperature detecting elements $E_1$ through $E_6$ shown in FIG. 1.

FIG. 2 depicts a graph indicating the relationship between the value of the temperature Temp (°C) and the positions of the temperature detecting elements $E_1$ through $E_6$ shown in FIG. 1. It should be noted that the portion where the breakout BO is located on the inside wall of the mold M, is where the highest temperature occurs. Consequently, in this circumstance, two or more portions are not simultaneously affected, but only one portion is affected, at which portion the temperature of the upper temperature detecting element is lower than that of the corresponding lower temperature detecting element. This means that the aforementioned alarm signal is not activated, even though the breakout portion BO has been actually detected in the mold M.

According to the previously mentioned second cited reference, that is the Japanese patent application laid open No. 55(1980)-84259, a temperature detecting element is buried inside each of at least two walls comprising a mold. The method of this cited reference resides in that a difference in the temperature between said temperature detecting elements is used as an index for determining whether or not a breakout portion exists in the mold.

However, in the second referenced method, the shortcoming occurs in that, although no such actual difference in temperature exists, the alarm signal is often generated, because a pseudo difference in temperature is measured by said at least two temperature detecting elements. For example, a pseudo difference in temperature occurs in a case where one of the pouring nozzles becomes closed, the centering of the pouring nozzle is not correct, or the flow of the molten steel is biased. Besides, in such a case, it is not easy to achieve the correct zero level adjustment with respect to the difference in temperature. Accordingly, as previously mentioned, it is difficult to accurately generate the alarm signal. Further, it should be noted that, according to this method, it is impossible to generate the alarm signal if the openings of the shell are formed on both of said two walls simultaneously, because said difference in temperature does not then occur between the two walls.

Figure 3A:
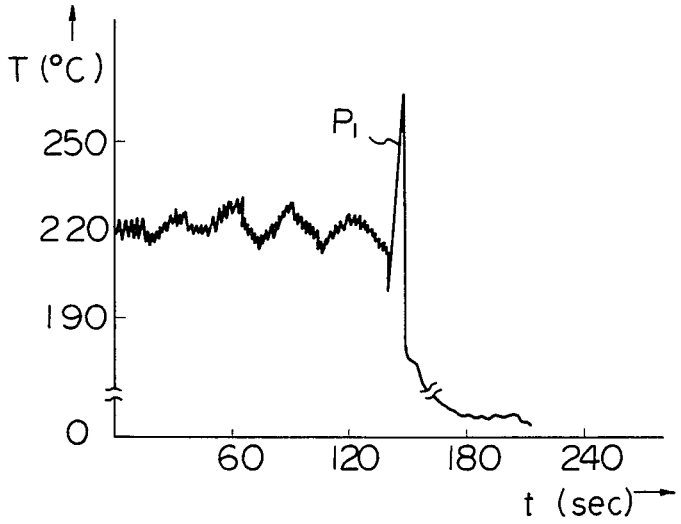
FIGS. 3A and 3B depict graphs indicating the relationships between the elapsed time and the temperature measured at one portion on the inside wall of the mold.
Figure 3B:
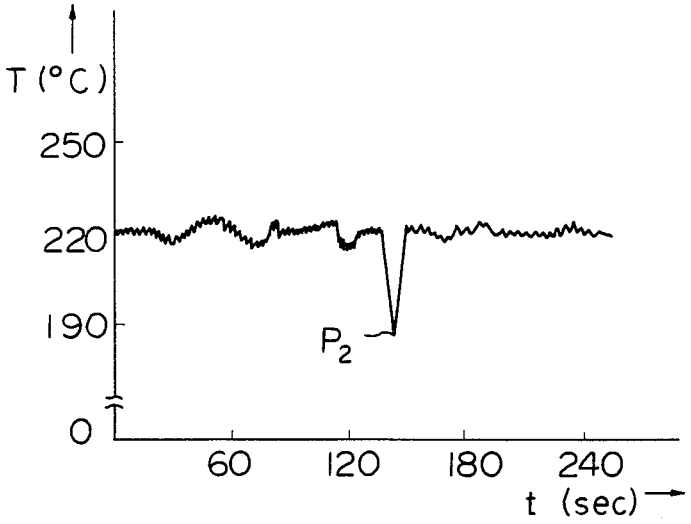

FIGS. 3A and 3B depict graphs indicating the relationships between the elapsed time and the temperature measured at one portion on the inside wall of the mold. In FIG. 3A, variation of the temperature T, measured on the inside wall, is proportional to the variation of the temperature $T_c$ (not shown), measured at the surface of the casting steel flowing inside the mold. The graph of FIG. 3A is obtained under the following conditions. That is, the temperature detecting element, such as a thermocouple, is buried at a position which is lower than 20 mm from the surface of the molten steel bath, but not lower than 700 mm from said surface, and, second, between 1 mm and 30 mm from the surface of the inside wall of the mold. Once the shell is stuck to the inside wall of the mold at a level close to the surface of the molten steel bath, then the opening of the shell is formed due to the downward force applied by the non-fixed shell and, also, a vibration occurs to the mold itself. If the opening grows large in size, the molten steel abuts directly against the inside wall of the mold. This causes a quick and high temperature rise, which is clearly shown as a sharp rising peak $P_1$ in FIG. 3A. If such a state is left as it is, the opening is gradually made large in size, and, accordingly, there is not chance to remedy the opening of the newly coagulated shell. When such an opening of the shell succeeds in going through the mold, the undesired breakout is very liable to occur. Therefore, when an opening is first detected, it is effective to stop the rotation of the pinch roller for about thirty seconds, or, alternatively, to reduce the rotation speed, so as to cool down the temperature at the opening. Thereby, a breakout can be prevented from occurring.

Large-size particles of an inclusion, made of non-metal, sometimes appear in the molten steel. To be more specific, inclusions are usually floating on the surface of the molten steel bath. The inclusions are composed of rolling powder flowing down from the surface of the molten steel bath or composed of rolling slag from a tundish. These inclusions coagulate as one body and form a large-size particle. If such inclusion particles appear in large numbers in the molten steel, the temperature T of the shell adjacent to any such large-size inclusion particle is quickly decreased, which is clearly shown as a sharp falling peak $P_2$ in FIG. 3B. If such a state is left as it is, the undesired breakout is very liable to occur. At that time, it is effective, as stated in the aforementioned case of the peak $P_1$, to stop the rotation of the pinch roller for about thirty seconds, or, alternatively, to reduce the rotation speed, so that the occurrence of a breakout may be prevented.

Figure 3C:
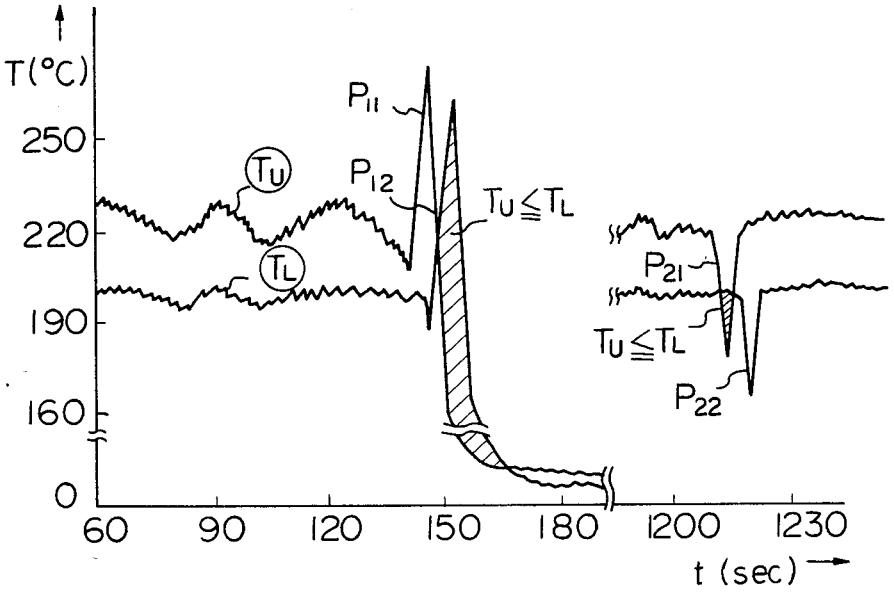
FIGS. 3C and 3D depict graphs indicating the relationships between the elapsed time and the temperature measured at two portions on the inside wall of the mold.
Figure 3D:
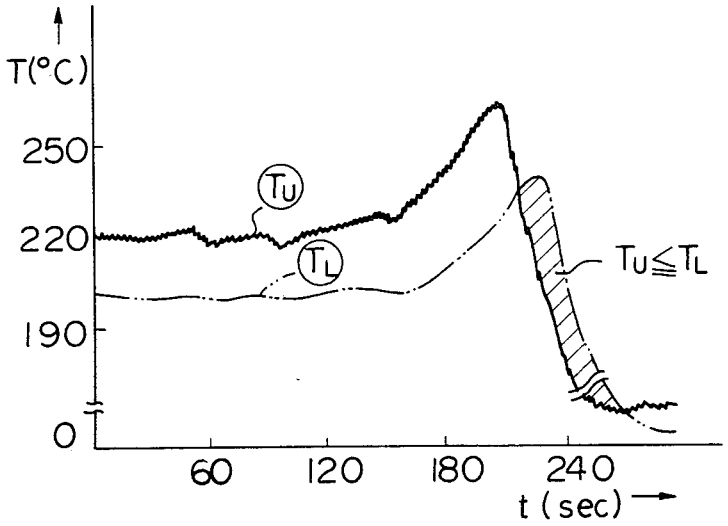

FIGS. 3C and 3D depict graphs indicating relationships between the elapsed time and the temperature measured at two portions on the inside wall of the mold. The upper and lower temperature detecting elements, such as thermocouples, are buried in the inside wall of the mold, along the flow of the casting steel, and both are located lower than the surface of the molten steel bath. If an opening of the shell occurs or if a large-size inclusion particle is contained in the casting molten steel, the temperature $T_U$ from the upper thermocouple and the temperature $T_L$ from the lower thermocouple vary, as shown in the graph of FIG. 3C. The curves $T_U$ and $T_L$ represent the variation of the temperatures $T_U$ and $T_L$, respectively. The first sharp rising peak $P_{11}$ indicates a high temperature, but, during the flow of the steel, the peak $P_{11}$ then indicates a low temperature.

Similarly the second sharp rising peak $P_{12}$ indicates a high temperature, but, during the flow of the steel, the peak $P_{12}$ then indicates a low temperature. Therefore, it should be noticed that a temperature inversion takes place, as seen in FIG. 3C. The temperature inversion is schematically indicated by a hatched area defined by the expression of $T_U \leqq T_L$. It should be understood that an identical temperature inversion also takes place regarding the sharp falling peak $P_2$ of FIG. 3B, as schematically indicated in FIG. 3C by a hatched area defined by the expression of $T_U \leqq T_L$.

A similar temperature inversion of $T_U \leqq T_L$ also takes place in a case where, first, the level of the surface of the molten steel is higher than the level at which the upper thermocouple is positioned, which is usual but, thereafter, the level of the surface of the steel drops toward the upper thermocouple (refer to the rising portion of the curve $T_U$ in FIG. 3D), then is level with the upper thermocouple (refer to the top of the curve $T_U$), and thereafter drops lower than the lower thermocouple (refer to the falling portion of the curve $T_U$). In this case, such a temperature inversion is schematically indicated by a hatched area in this FIG. 3D, as defined by the expression $T_U \leqq T_L$.

The present invention is based on the above-mentioned fact of temperature inversion. That is, the abnormality of the casting steel is detected from the temperature inversion between the detected temperatures $T_U$ and $T_L$. The occurrence of the opening of the shell induces the variations depicted by the sharp rising peaks $P_{11}$ and $P_{12}$ shown in FIG. 3C. However, the existence of a large-size inclusion particle induces the variations depicted by the sharp falling peaks $P_{21}$ and $P_{22}$ shown in the same figure. Consequently, the circumstance of whether an opening of the shell occurs or whether a large-size inclusion particle exists, is clearly distinguished, in the following manner. When the average of the temperatures $T_U$ or the average of the temperatures $T_L$ is higher or lower than the present temperature $T_U$ or $T_L$, respectively, that condition represents the occurrence of an opening of the shell or the existence of a large-size inclusion particle, respectively. The average may be obtained as, for example, an arithmetic mean, a harmonic mean or an envelope of the curve of the temperature.

As seen from FIG. 3A, when the opening of the shell is produced in the mold, the temperature T rises sharply. However, when an impurity particle exists therein, the temperature T falls sharply, as seen from FIG. 3B. Contrary to the above, the change in the temperature T, due to a variation in the level of the surface of the molten steel bath, is not sharp. Therefore, an abnormality can be found by detecting a sharp rise in the temperature or a sharp drop in the temperature. In the present invention, determining the temperature inversion between $T_U$ and $T_L$ is not only possible, but it is also possible to determine a change in the ratio, that is $\Delta T/\Delta t$ ($\Delta T$ denotes the amount of the temperature change, $\Delta t$ denotes the time in which the change $\Delta T$ is performed), thereby detecting an abnormality. It should be noted that if the value of the ratio $\Delta T/\Delta t$ is outside a predetermined range and, at the same time, has a positive polarity ($+\Delta T/\Delta t$), it is determined that the abnormality is that of an opening in the shell in the mold. Contrary to this, if the value of the ratio $\Delta T/\Delta t$ is outside the predetermined range and, at the same time, has a negative polarity ($-\Delta T/\Delta t$), it is determined that the abnormality is that of a large-size inclusion particle.

The above-mentioned sharp rise or fall of the temperature may occur in cases other than the aforementioned cases where an abnormality occurs. For example, the level of the surface of the molten steel bath may also vary in a case when the casting speed is changed or when a new ladle is required. Therefore, it is necessary to clearly distinguish the reason for the sharp temperature change, i.e., whether the change was due to the occurrence of an abnormality or whether it was due to a change of the casting speed or a new ladle. However, it is very easy to distinguish the former change from the latter change. This is because the latter type of changes can usually be predicted in advance, with reference to the operation schedule in each iron factory.

Figure 4:
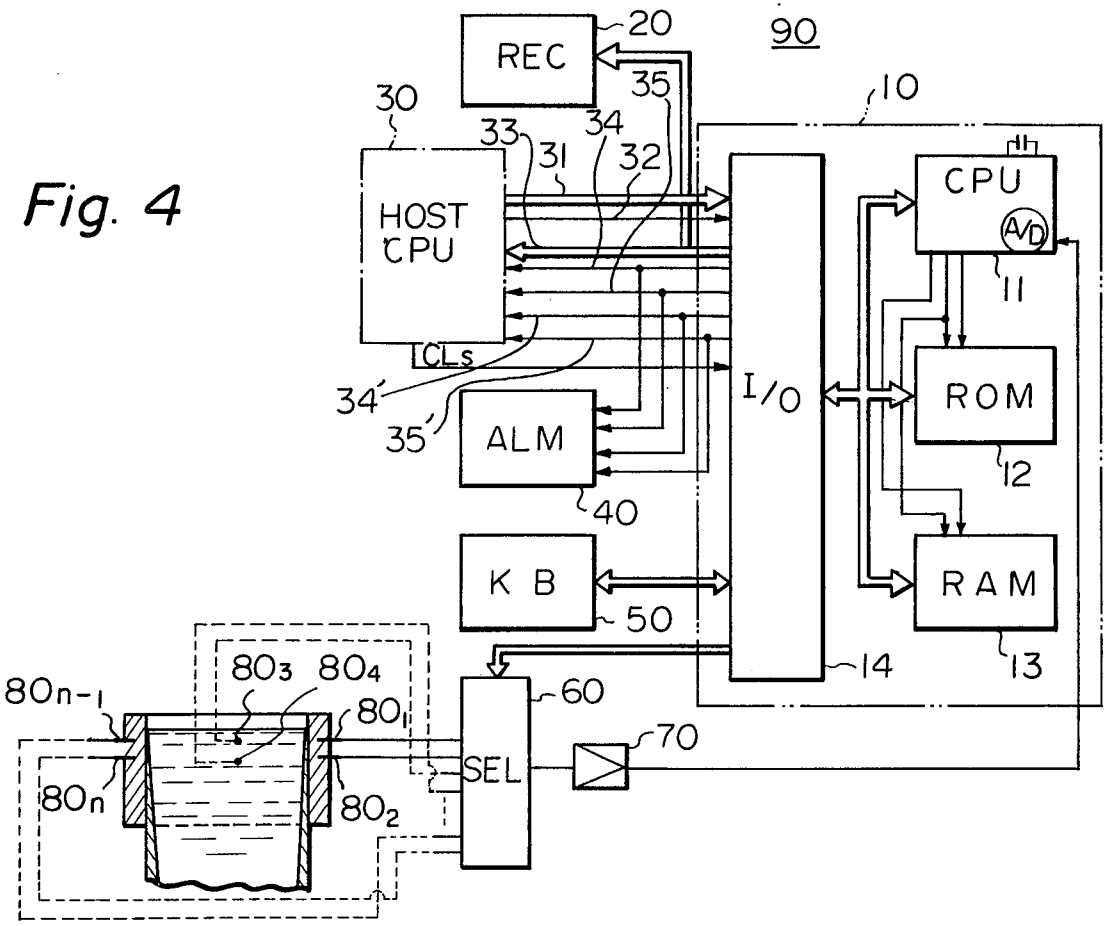
FIG. 4 is a block-schematic diagram of one example of a system for detecting an abnormality of the shell in the mold, according to the present invention; and, FIGS. 5A through 5I depict flowcharts, used for explaining the operation of the system shown in FIG. 4.

FIG. 4 is a block-schematic diagram of one example of a system for detecting an abnormality in the shell of a mold, according to the present invention. And, FIGS. 5A through 5I depict flowcharts, which are used for explaining the operation of the system shown in FIG. 4. The reference numeral 90 in FIG. 4 represents a system for detecting an abnormality of the shell. The major part of the system 90 is an abnormality detecting and discriminating apparatus 10. The apparatus 10 is comprised of a central processing unit (CPU) 11, a ROM (read-only memory) 12, a RAM (random-access memory) 13 and an I/O (input/output) port 14. Preferably, the apparatus 10 is fabricated as a so-called microcomputer. The I/O port 14 is connected to a recorder (REC) 20 for recording temperatures T measured at respective portions in the inside wall of the mold, a host computer (HOST CPU) 30, constructed as an operating panel, for supervising the system 90, an alarm indicator (ALM) 40, an input/output keyboard (KB) 50 and an element selector (SEL) 60. The element selector 60 is made of analogue selection switches. An analogue output from the selector 60 is applied, via an amplifier 70, to an A/D (analogue/digital) converting input terminal A/D of the CPU 11.

The operations of the system 90 are as follows. Various sets of information are, first, supplied from the host computer 30 to the abnormality detecting and discriminating apparatus 10 (hereinafter referred to merely as a microcomputer). The various sets of information are, for example, predetermined casting speed, speed change, exchange of the ladle, casting conditions (including the discrimination factor, mentioned hereinafter), operation data, a set instruction for starting the abnormality detecting operation and so on. The set instruction is transferred on a line 32. The information, other than the set instruction, is transferred on a data bus 31. The host computer 30 also produces sampling clock pulses $CL_s$ which are input to the I/O port 14. Each sampling clock pulse $CL_s$ is produced every time the casting steel moves a predetermined constant length. A bus 33 transfers the temperature data and the position data.

The ROM 12 in the microcomputer 10 stores program data for executing the abnormality detecting and discriminating operation. The microcomputer 10 is operated according to the program data. When the above-mentioned set instruction is supplied from the host computer 30, data in the I/O port 14 are initialized and, at the same time, data stored in a specified memory area of the RAM 13 are also initialized. Every time the clock pulse $CL_s$ is generated, data indicating the temperature of the mold is read one by one. To be more specific, the temperatures are measured by n thermocouples. Half (n/2) of the thermocouples are distributed around and at the upper inside wall of the mold, as upper thermocouples $\mathbf{80}_1, \mathbf{80}_3, \ldots \mathbf{80}_{n-1}$, while the remaining half of the thermocouples are distributed around and at the lower inside wall of the mold, as lower thermocouples $\mathbf{80}_2, \mathbf{80}_4, \ldots \mathbf{80}_n$. Each detected temperature from an upper thermocouple is indicated by the previously used symbol $T_U$ while each detected temperature from a lower thermocouple is referenced by the previously used symbol $T_L$. The data of the temperatures measured and read from the thermocouples are stored in the respective memory areas which are allotted in advance to each thermocouple. In this case, the temperatures measured by each corresponding two upper and lower thermocouples, such as $(\mathbf{80}_1, \mathbf{80}_2), (\mathbf{80}_3, \mathbf{80}_4) \ldots (\mathbf{80}_{n-1}, \mathbf{80}_n)$ are treated as a pair of temperatures. Half of the temperature pairs are sequentially measured and read by the corresponding thermocouples one by one every time each clock pulse $CL_s$ is generated. When a predetermined m clock pulses have been generated, the abnormality detecting and discriminating operation is started. At this time, m data indicating the measured temperatures have been stored in the respective memory areas of the RAM 13. The read operations in the memory areas are conducted under a timesharing scanning mode. That is, when the clock pulse $CL_s$ is generated, the element selector 60 specifies the analogue selection switch ($AS80_1$) (not shown) to be closed, and the analogue data from the thermocouple $80_1$ is converted into the corresponding digital data, by way of the A/D converting input terminal A/D of the CPU 11. Then the digital data is stored in the memory area (hereinafter referred as an average memory area) of the RAM 13 allotted to the thermocouple $80_1$. Similarly, when sequential clock pulses $CL_s$ are generated, the element selector 60 specified the analogue selection switches ($AS80_2$) ($AS80_3$) . . . ($AS80_{n-1}$) ($AS80_n$), so as to sequentially close the respective analogue selection switches. The selected analogue data from the thermocouples $80_2$, $80_3$ . . . $80_{n-1}$, $80_n$ are sequentially converted into the corresponding digital data, by way of the A/D converting input terminal A/D, and then stored in each of the average memory areas allotted thereto, respectively.

After m temperature data per each thermocouple ($80_1$–$80_n$) are stored in their respective average memory areas, a first discrimination for the aforesaid expression $T_U \geqq T_L$ and a second discrimination for the aforesaid expression $\Delta T/\Delta t$ are performed, every time the clock pulse $CL_s$ is generated, with regard to each pair of thermocouples ($80_1$, $80_2$), ($80_3$, $80_4$) . . . ($80_{n-1}$, $80_n$), sequentially. If an abnormality is discriminated as occurring, the information of such abnormality is transferred to the host computer 30 and the alarm indicator 40. During the production of the normal results from the first and second discriminations, the average values, that is $$\sum_{i}^{i+m-1} T_U/m \text{ and } \sum_{i}^{i+m-1} T_L/m,$$

are renewed, sequentially, in such a manner that when new temperature data is introduced, the oldest temperature data is removed from the corresponding average memory area. The temperature data are also supplied to the recorder 20 and the host computer 30.

The operation of the system 90 of FIG. 4 will be further clarified with reference to the time charts depicted in FIGS. 5A through 5I. It should be understood that, although the time charts represent the operation with regard only to one pair of thermocouples, that is thermocouples $80_1$ and $80_2$, identical time charts also stand with regard to each pair of the remaining thermocouples ($80_3$, $80_4$) . . . ($80_{n-1}$, $80_n$), every time the clock pulse $CL_s$ is generated.

When the set instruction is supplied, via the line 32 from the host computer 30 (refer to a step A1), the microcomputer 10 executes the initialization operation in which data stored in all the average memory areas are cleared and the data specified by the input/output keyboard 50 are also cleared. Then, input data, regarding information of the casting conditions, the operation data and so on are read and, at the same time, reference data for the aforesaid discriminations, such as $K_U$, $K_{U1}$ through $K_{U4}$, $K_L$, $K_{L1}$ through $K_{L4}$ are introduced into the microcomputer 10 (refer to step A2). The above-mentioned reference data $K_U$–$K_L$ are defined in advance, according to given conditions for the casting operation and so on.

When each clock pulse $CL_s$ is generated (refer to step A3), the temperature is measured and the corresponding digital data of the same is written in the corresponding area of the average memory. When the reading of m temperature data per each thermocouple is finished by using the count memory areas in the RAM 13 (refer to step A4), then the average values $$\sum_{i}^{i+m-1} T_U/m \text{ and } \sum_{i}^{i+m-1} T_L/m$$

(hereinafter referred simply as $\Sigma T_U/m$ and $\Sigma T_L/m$) are stored in the respective average value memory areas of the RAM 13 and the respective count memory areas are cleared (refer to step A5). The above-mentioned steps are classified as sequence 1.

When the next clock pulse $CL_s$ is generated (refer to step B1 in FIG. 5B), the measured temperature $T_U$ from the upper thermocouple $80_1$ and the measured temperature $T_L$ from the lower thermocouple $80_2$ are read (refer to step B2). If the expression $T_U \leqq T_L$ stands (refer to step B3), a step B7 starts, but, if not, a step B4 starts. When the $T_U \leqq T_L$ stands, the logic "1" is set and stored in an inversion memory area of the RAM 13 (refer to step B7 and step B8), which logic "1" indicates that the aforementioned temperature inversion (the hatched areas in FIGS. 3C and 3D) takes place. At this time, the count number 1 is applied to an inversion-count memory area of the RAM 13 (refer to step B9). The gist of the inversion-count memory area is counted incremently by 1, every time the pulse $CL_s$ is generated. Thus, if it is determined that the relationship $T_U \leqq T_L$ exists, an abnormality is expected to occur. Especially, if a relationship $T_L > \Sigma T_L/m$ stands, it is determined that the aforementioned breakout (BO) is produced (refer to step B10 and again to FIG. 3C), while, if a relationship $T_L \leqq \Sigma T_L/m$ stands, it is determined that an aforesaid large-size inclusion particle is contained in the casting steel (refer also to FIG. 3C). In order to increase the accuracy of the discrimination, the following method is employed. For example, during the generation of the subsequent three clock pulses $CL_s$, if at least once the relationship $T_U \leqq T_L$ does not stand (refer to a step B5), it is considered that the relationship $T_U \leqq T_L$ is not correct and may be induced by an external noise or ordinary operational change in routine work. In such a case, the information in the inversion memory area and the inversion-count memory area, are cleared (refer to a step B6). Thus, a sequence 7 in which the discriminations of the temperature inversions are conducted, is completed.

Figure 5A:
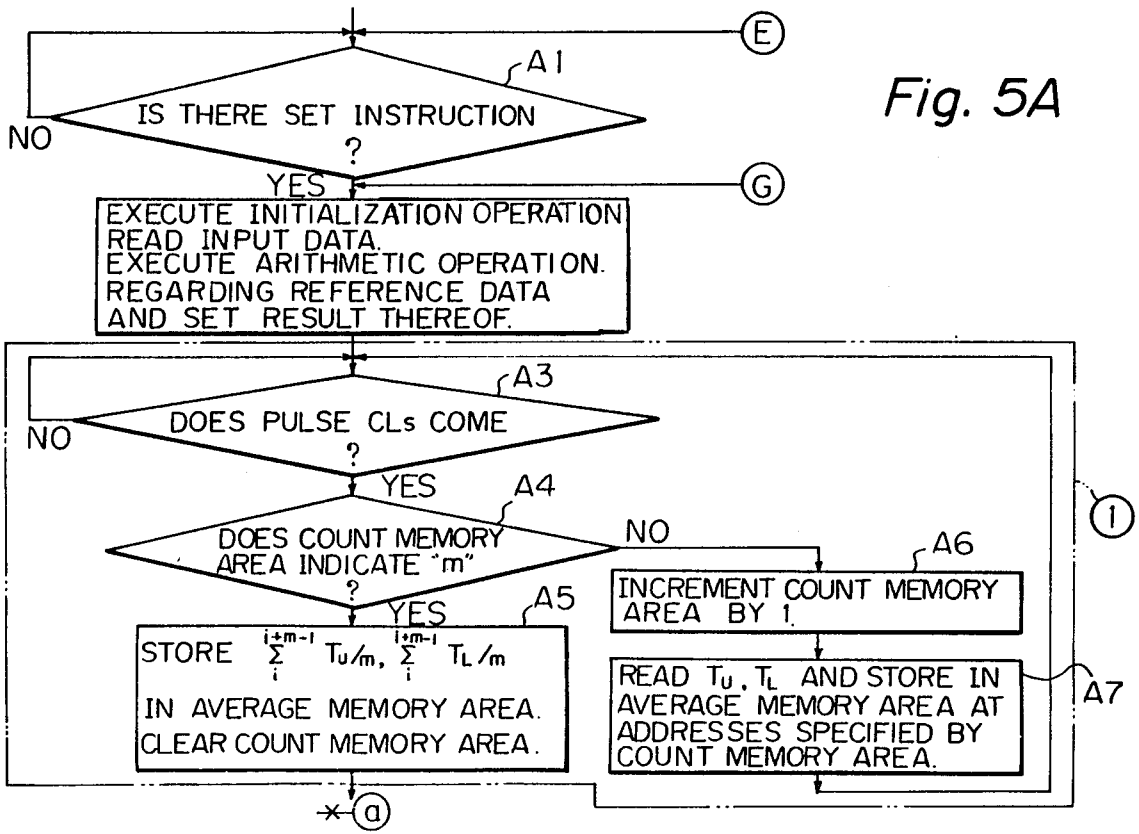
Figure 5B:
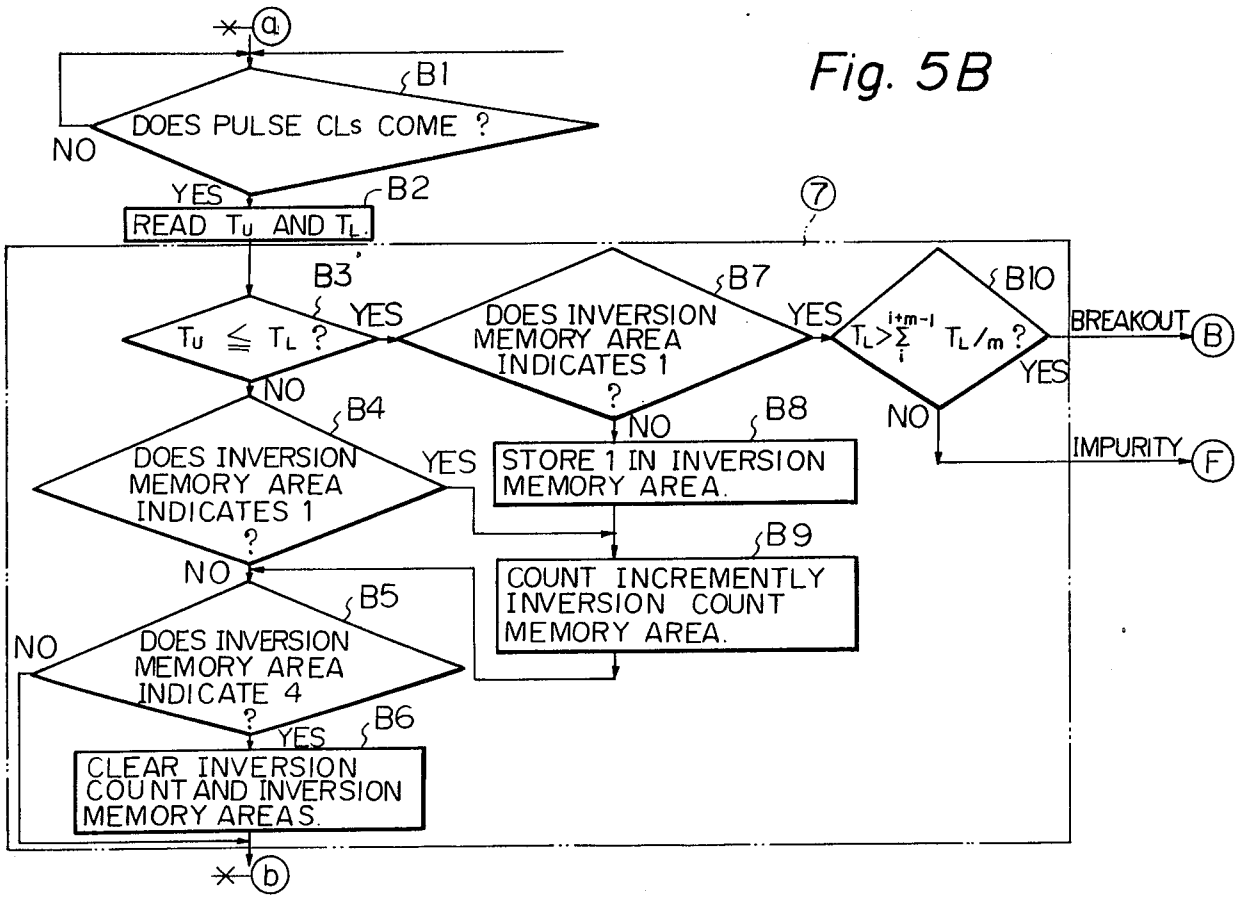
Figure 5C:
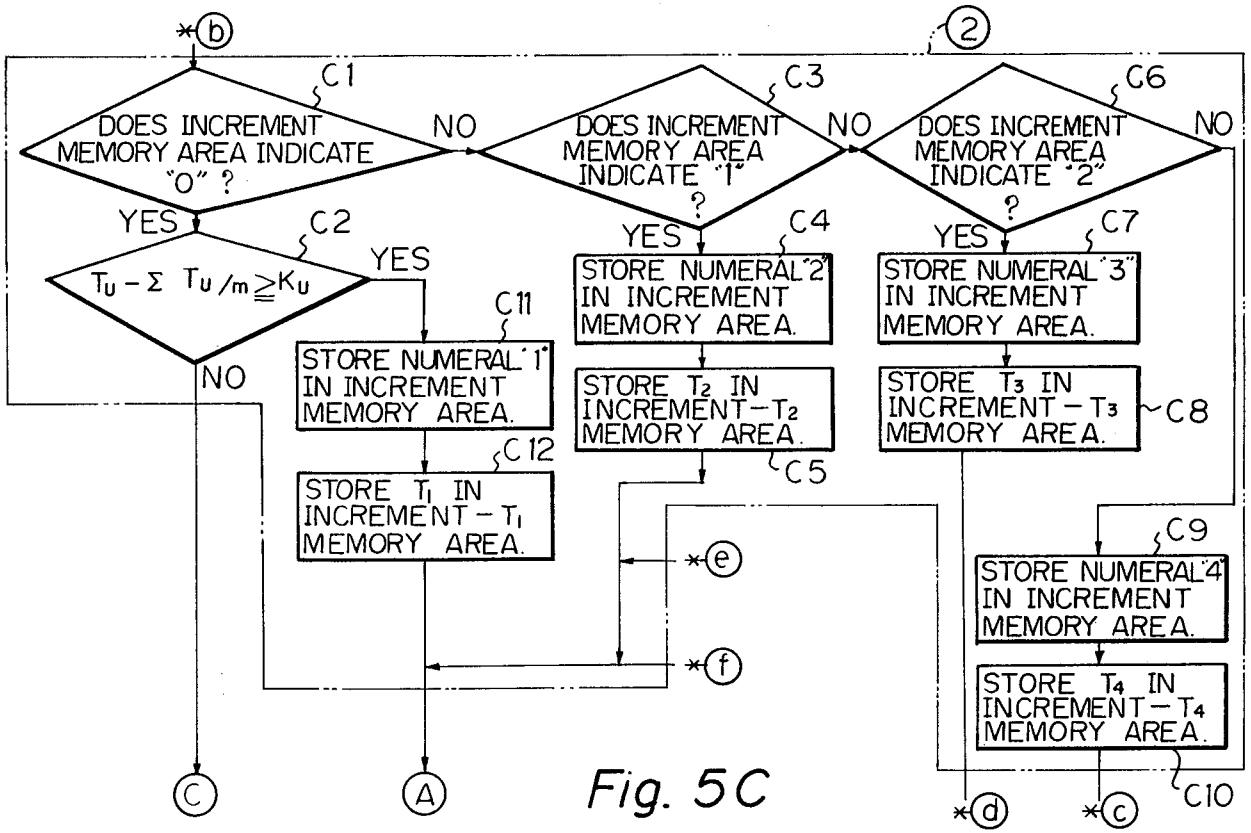
Figure 5D:
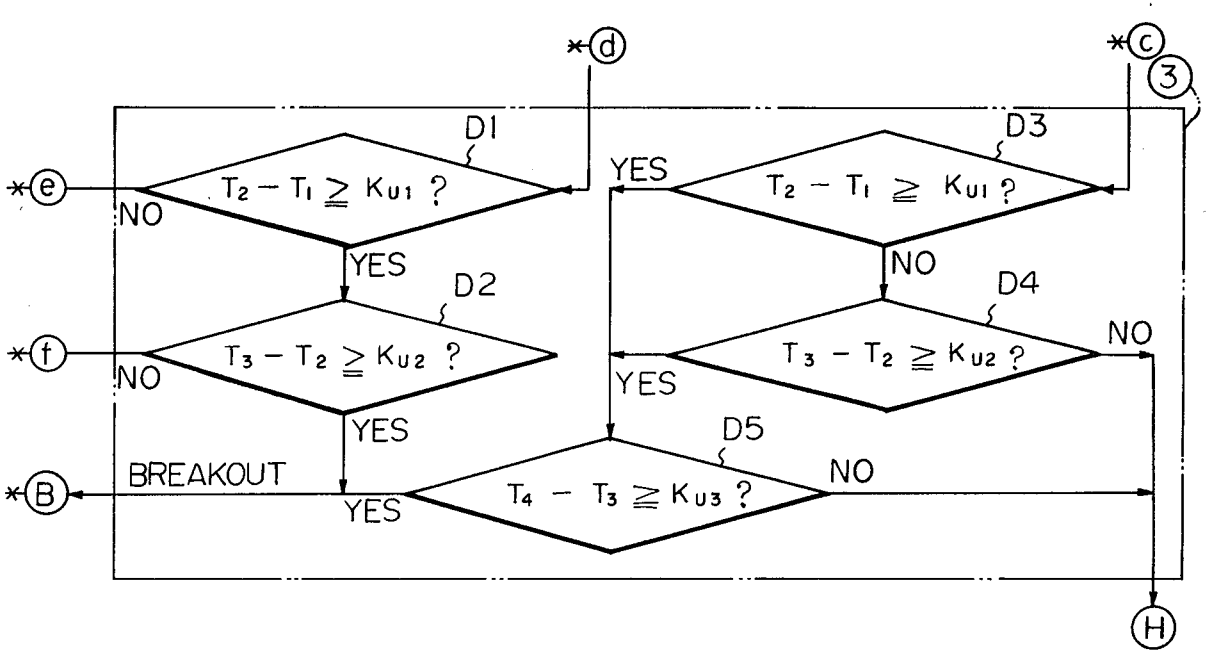
Figure 5E:
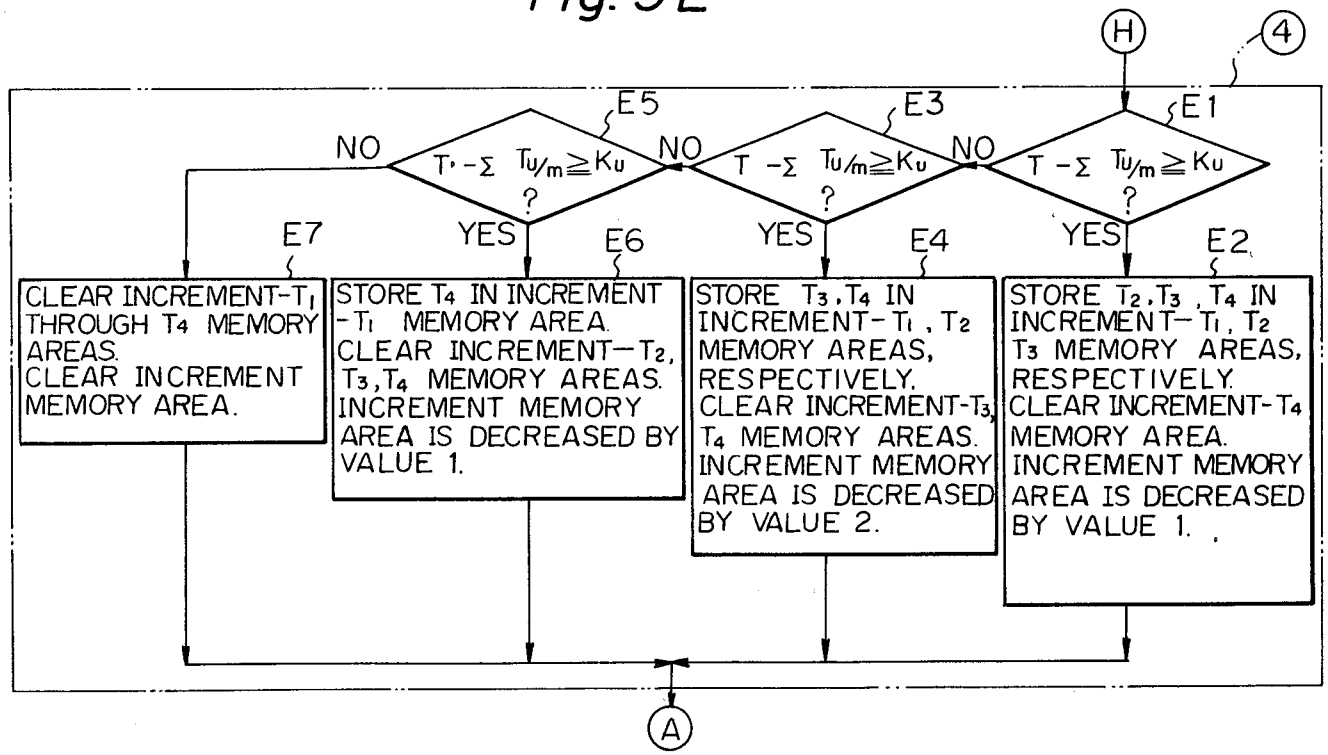

In the sequence 7, if an abnormality is determined not to exist, then a sequence 2 of FIG. 5C starts. In this sequence, it is discriminated whether or not a relationship $$T - \Sigma T_U/m \geqq K_U$$

stands. (Refer to step C2.) If the result is "YES", it is found that the present temperature T is abnormally high. In this case, the numeral 1 is set and stored in an increment memory area of the RAM 13 (refer to step C11). Then the abnormally high present temperature T is stored, as a first abnormally high temperature $T_1$, in an increment-$T_1$ memory area of the RAM 13 (refer to step C12). If the increment memory area indicates the numeral 1, the numeral is sequentially increased 2→3→4, every time the clock pulse $CL_s$ is generated (refer to steps C4, C7 and C9). At this time, the respective present temperatures $T_2$, $T_3$ and $T_4$ are stored, as second, third and fourth abnormally high temperature data, in the increment-$T_2$, the increment-$T_3$, and the increment-$T_4$ memory areas of the RAM 13 (refer to steps C5, C8 and C10). Next, a sequence (3) (FIG. 5D) starts. In this sequence, it is discriminated whether or not the relationships $T_2-T_1 \geqq K_{U1}$ and $T_3-T_2 \geqq K_{U2}$ stand (refer to steps D1 and D2). If the results are "YES", it is determined that a breakout (creation of an opening of the shell) will soon take place. This is because the present temperature is being sharply increased during the generation of two successive clock pulses $CL_s$. On the contrary to this, if either one of the steps D1 and D2 provides the result of "NO", it is found that such an abnormally high temperature occurs merely in one cycle of the clock pulses $CL_s$. Accordingly, in such a case, further observation of the temperature is conducted when the subsequent pulse $CL_s$ is generated, so that the numeral 4 is set in the increment memory area (refer to step C9) and also the fourth abnormally high temperature $T_4$ is stored in the increment-$T_4$ memory area (refer to step C10). Then it is discriminated whether or not at least two relationships among the three stand, which three relationships are $T_2-T_1 \geqq K_{U1}$, $T_3-T_2 \geqq K_{U2}$ and $T_4-T_3 \geqq K_{U3}$. If the discrimination provides a result of "YES", it is determined that the abnormality of the breakout exists. Contrary to this, if the result is "NO", it is determined that the present temperature is not sharply increasing. Therefore, a sequence (4) (FIG. 5E) starts. In this sequence (4), data $T_i$ is searched out, which can satisfy a relationship of $$T_{i=2\text{-}4}-\Sigma T_U/m \geqq K_U$$

If such data $T_i$ is found, the information of the aforesaid increment-$T_1$ memory area is rewritten by this data $T_i$. Simultaneously, the numeral of the aforesaid increment memory area is decreased by the value i of the $T_i$. The reason for this is as follows. Regarding the temperature $T_1$, it has already been known that the value $T_1$ satisfies the relationship of $T_1-\Sigma T_U/m \geqq K_U$ through the step C2 in FIG. 5C. However, regarding the temperatures $T_2$ through $T_4$, it is not known whether or not these values ($T_2$–$T_4$) satisfy the respective relationships which are analogous to the above-recited relationship of $T_1-\Sigma T_U/m \geqq K_U$. This is because, in FIG. 5C, the steps C3 and C6 are not accompanied by the steps, similar to the step C2, but shown, in FIG. 5E, as steps E1, E3 and E5. Accordingly, the information of the increment-$T_1$ memory area must be rewritten by data which indicates the highest temperature among the newly introduced data $T_2$ through $T_4$ and simultaneously measured at a time being very close to the time in which the temperature $T_1$ has been measured. These operations are clarified by steps E2, E4, E6 and E7 in FIG. 5E. Thereafter, the discrimination of $\Delta T/\Delta t$ is achieved by using the above-mentioned newly rewritten data as the starting point.

Figure 5F:
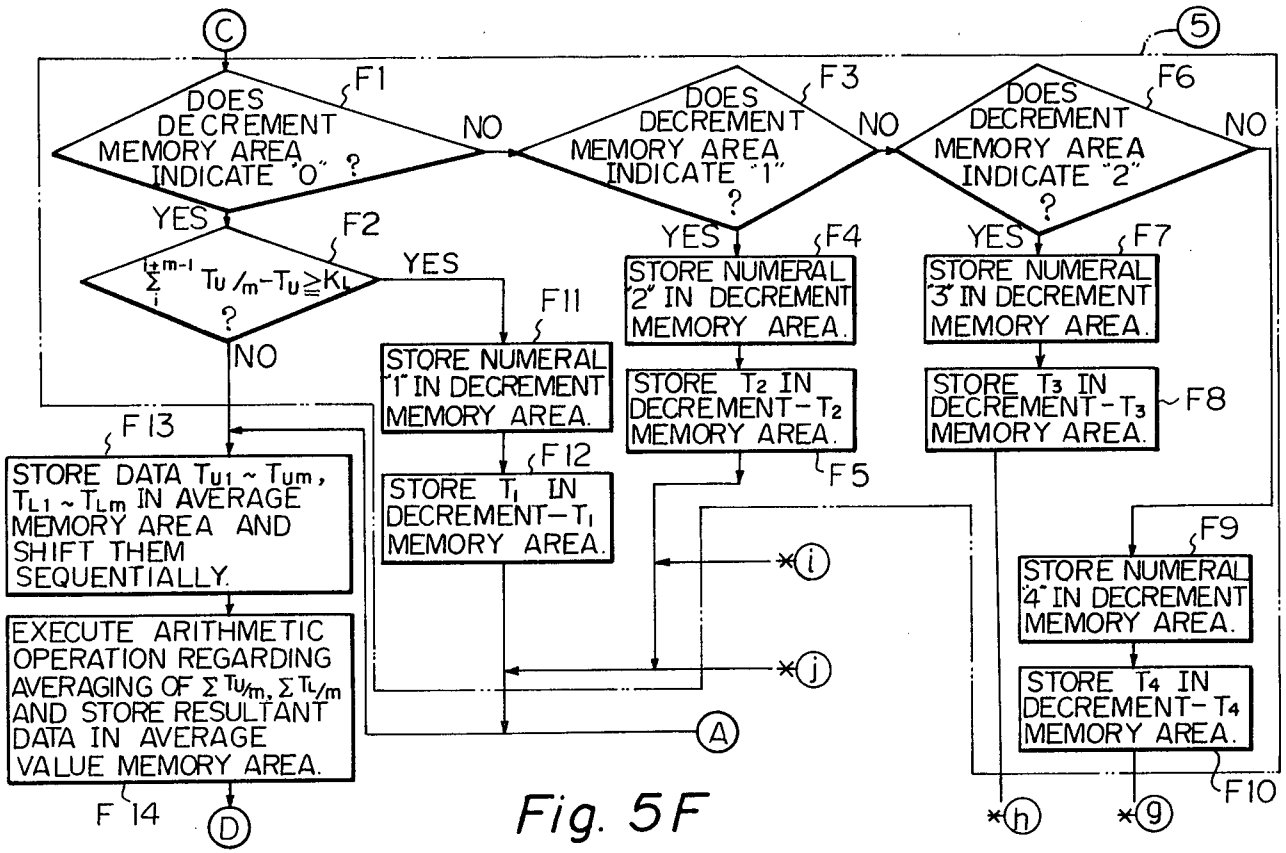
Figure 5G:
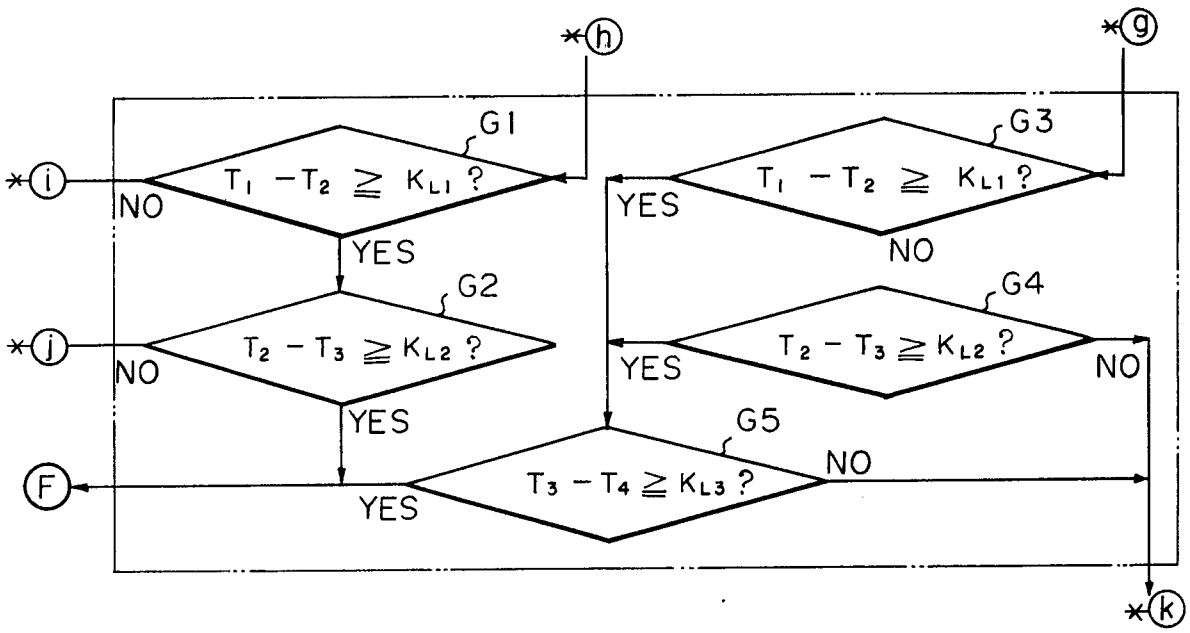
Figure 5I:
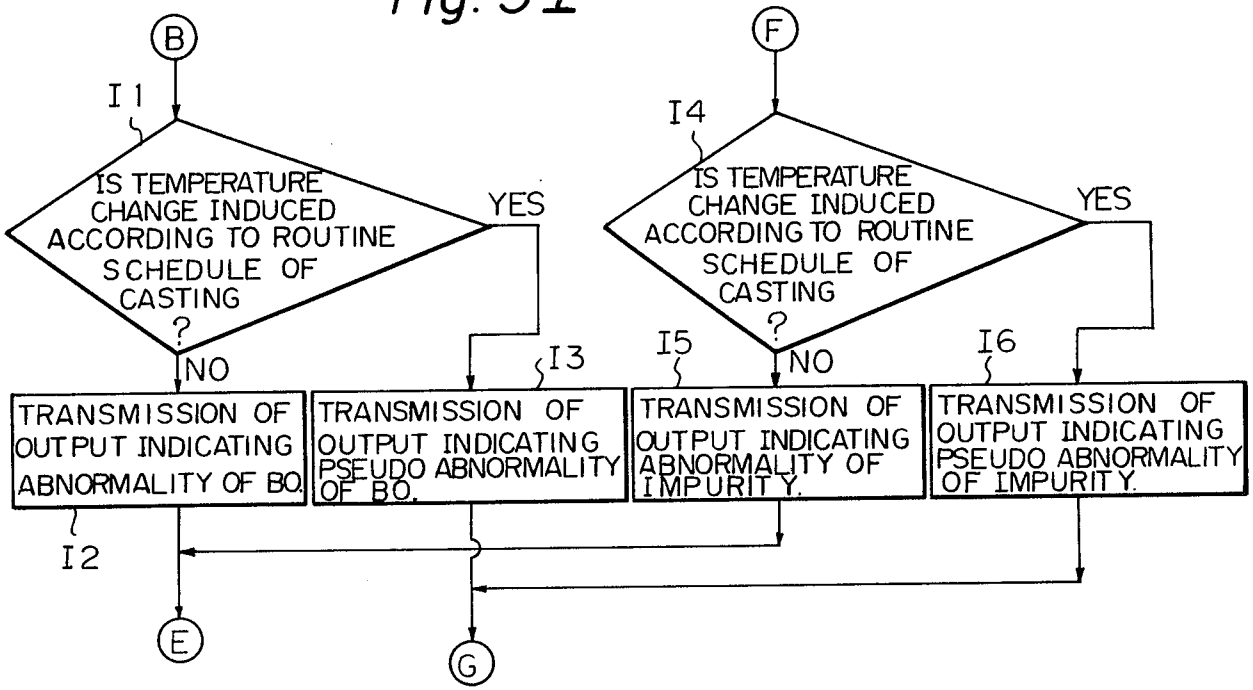

When it is determined that an abnormality of a breakout (BO) exists, the operational sequence jumps to a port (B) shown in FIG. 5I. Then the input data, regarding the operation schedule of the casting equipment, is referred to. According to the operation schedule, if it is concluded that such a sharp temperature rising is not expected to occur, it is determined that the sharp temperature rising may really indicate a breakout (refer to a step I1 in FIG. 5I). Then an output indicating a possible abnormality BO (breakout) is transmitted, via a line 34 in FIG. 4. At the same time, the alarm indicator 40 of FIG. 4 is activated by the output indicating BO. The host computer 30 of FIG. 4 analyzes the output BO and determines whether a breakout is liable to actually occur, or not. If the determination is "YES", the host computer 30 commands the casting speed to be reduced or commands the casting to momentarily stop, so as to remedy the opening of the shell by cooling down the temperature at this opening. The operator will carry out the command made by the host computer 30. When the temperature has been reduced due to the slowing or the stopping of the casting, the operator restores the normal casting speed again. At this time, the host computer 30 supplies a set command to the microcomputer 10 of FIG. 4. In this case, if the set command activates information for carrying out an operation, which will cause the temperature to become high, during routine casting, then, the microcomputer 10 transmits, via a line 35 of FIG. 4, an output indicating a pseudo abnormality of BO (refer to a step I3 in FIG. 5I). In a case where the microcomputer 10 transmits the output to the host computer 30 indicating an abnormality that will cause a BO, the microcomputer 10 waits to receive a new set command therefrom. Contrary to the above, in a case where the microcomputer 10 transmits the output to the host computer 30 indicating a pseudo abnormality that will cause a BO, the microcomputer 10 undergoes initialization operation, so that the aforementioned abnormality detecting and discriminating is restarted automatically again. Lines 34' and 35' (FIG. 4) transfer outputs similar to the outputs transferred via the lines 34 and 35, respectively; however, the lines 34' and 35' do not concern a breakout, but concern large-size impurity particles.

The discrimination of $\Delta T/\Delta t$, in order to distinguish a breakout from a large-size impurity particle, is also achieved in a manner (refer to a sequence (5) in FIG. 5F) similar to the manner (refer to the sequence (2) in FIG. 5C) in which the aforesaid abnormality causing a BO is detected in the sequence (2) of FIG. 5C. However, regarding the large-size impurity particle, not a sharp rise of the temperature, as is the BO, but a sharp fall of the temperature is measured, as shown in FIG. 3B. Thus, in the discrimination of a large-size impurity particle, a relationship $\Sigma T_U/m = T \geqq K_L$ is referred to. If this relationship stands, it is found that the temperature is abnormally low. Thereby, the abnormality detecting and discriminating operation, regarding $\Delta T/\Delta t$, is started. In the sequence (5) of FIG. 5F, the temperature data T ($T_1$–$T_4$) are stored in the decrement-$T_1$, $T_2$, $T_3$, $T_4$ memory areas of the RAM 13, every time the clock pulse $CL_s$ is generated, as in the sequence (2) of FIG. 5C. Then, a discrimination is conducted as to whether or not at least two relationships among the three stand, which three are $T_1-T_2 \geqq K_{L1}$, $T_2-T_3 \geqq K_{L2}$ and $T_3-T_4 \geqq K_{L3}$ (refer to steps G1 through G5 in FIG. 5G). If the discrimination provides a result of "YES", it is determined that an abnormality of a large-size impurity particle exists. The detecting and discriminating steps are similar to those of the aforementioned breakout, but the existence of the impurity particle is determined when the changing ratio $\Delta T/\Delta t$ has a negative polarity not a positive polarity, as is the breakout; also, the value thereof should be outside the predetermined range simultaneously. A sequence (6) of FIG. 5H is analogous to the sequence (4) of FIG. 5E.

When no abnormality is detected, the oldest temperature data, stored in the aforementioned average memory area of the RAM 13, is replaced by newly measured temperature data (refer to a step F13 in FIG. 5F), so as to obtain new average values, that is $\Sigma T_U/m$ and $\Sigma T_L/m$, therein (refer to steps F13 and F14 in FIG. 5F).

According to the above-mentioned embodiment, the period of the sampling clock pulses $CL_s$ should be generated in synchronism with the casting speed, because the portion where the abnormality is likely to occur moves together with the flow of the casting steel. The period of the sampling clock pulses $CL_s$ corresponds to the item $\Delta t$ comprising the aforesaid changing ratio $\Delta T/\Delta t$. If the period of the pulses $CL_s$ is not generated in synchronism with the casting speed, it would be impossible to obtain the correct value of the ratio $\Delta T/\Delta t$. In addition, since the period of the pulses $CL_s$ is generated in synchronism with the casting speed, the detection of said temperature inversion can be achieved with a high degree of accuracy.

The aforementioned reference data $K_U$, $K_{U1}$ through $K_{U4}$, $K_L$, $K_{L1}$ through $K_{L4}$ are determined in accordance with the casting condition. For example, the temperature, measured at a certain portion in the inside wall of the mold when the casting steel flows at one speed, is not identical to the temperature, measured at the same portion in the mold when the casting steel flows at a different speed. This means that the initial reference data $K_U$ and $K_L$ should be defined according to the casting condition, such as the above-mentioned casting speed. In the embodiment, the host computer 30 supplies the reference data ($K_U$, $K_{U1}$–$K_{U4}$, $K_L$, $K_{L1}$–$K_{L4}$), suitable for the respective casting condition, to the microcomputer 10.

In the aforementioned embodiment, in order to distinguish a pseudo abnormality from a real abnormality, when the relationship $T_U \leqq T_L$ stands only one time, it is determined that the abnormality is not a real one, that is, it is a pseudo abnormality, but when such relationship stands during successive clock pulses, that is three times or more, it is determined that the abnormality is a real one. Thus, a pseudo abnormality is prevented from being treated as a real one.

In the aforementioned embodiment regarding the sequences (2) (FIG. 5C) and (5) (FIG. 5F), the temperature inversion is detected from the fact that the present temperature T is higher or lower, by a predetermined value, than the average temperature. Thus, a pseudo temperature inversion is prevented from being treated as a real one. Such a pseudo temperature may be detected due to an external noise or fine vibrations of the temperature shown in FIGS. 3A through 3D.

The sharp rising or falling of the temperature, due to a breakout or a large-size impurity particle, usually continues for more than ten seconds, but less than forty seconds when a conventional speed is used for the casting. Therefore, if the period of the sampling clock pulses $CL_s$ is set as being in a range between several hundredths miliseconds and several seconds, the above-mentioned phenomena of a sharp rising or falling of the temperature occurs between several periods and several tens of periods of the sampling clock pulses $CL_s$. Accordingly, when the temperature data $T_1$ through $T_4$ are collected during the generation of four successive periods of the pulses $CL_s$, as in the aforementioned embodiment, the value of these data may typically change sharply as occurs in $T_1<T_2<T_3<T_4$ or $T_1>T_2>T_3>T_4$. However, such a continuous change is not always expected to occur. Since, first, the temperature data is collected in a very short time, and, second, the fine vibrations of the temperature always exist, there is a probability that such a continuous change will be partially broken. In order to cope with such an uncontinuous change of the temperature, in the aforementioned embodiment, an abnormality is deemed to be a real abnormality only in a case where the changing ratio $\Delta T/\Delta t$ exceeds the predetermined level during the generation of at least three successive clock pulses. Even if one abnormality is missing to detect within the four period of the clock pulses $CL_s$, it is not serious, because the discriminations are continuously performed by changing the temperature data one by one.

As explained in detail, according to the present invention, an abnormality which may induce a breakout can be detected with a high degree of probability before such an abnormality passes from the mold. Thus, a breakout can completely be prevented from occurring. In this case, if many pairs of upper and lower thermocouples are spaced equally around the inside wall of the mold, very accurate detection of such an abnormality can be performed.

We claim:

1. A method for detecting an abnormality of a solidified shell of casting liquid metal within a mold for continuous casting, comprising the following steps:

(a) repeatedly measuring temperatures along a direction of flow of said solidified shell, at upper and lower portions of an inside wall of the mold which is directly in contact with the solidified shell, both said portions being lower than a surface level of the liquid metal within the mold;

(b) detecting a first condition which is an occurrence of a temperature inversion between a temperature $T_U$ at said upper portion and a temperature $T_L$ at said lower portion, said inversion defined as $T_U \leqq T_L$;

(c) detecting a second condition defined by the last measured temperature $T_L$ being higher than the average value of the temperature $T_L$, with said average value being determined by one of an arithmetic mean, a harmonic mean and an envelope of a variation curve of said temperature $T_L$ as measured in a time series; and (d) discriminating the type of abnormality to be an opening of the solidified shell when said first and second conditions are simultaneously detected.

2. A method for detecting an abnormality of a solidified shell of casting liquid metal within a mold for continuous casting, comprising the following steps:

(a) repeatedly measuring temperatures located along a direction of flow of said solidified shell at upper and lower portions of an inside wall of the mold which is directly in contact with the solidified shell, both said portions being lower than a surface level of the liquid metal within the mold;

(b) detecting a first condition which is an occurrence of a temperature inversion between a temperature $T_U$ at said upper portion and a temperature $T_L$ at said lower portion, said inversion defined as $T_U \leqq T_L$;

(c) detecting a second condition defined by the last measured temperature $T_U$ being lower than the average value of the temperature $T_U$, with said average value determined by one of an arithmetic mean, a harmonic mean and an envelope of a variation curve of said temperature $T_U$ as measured in a time series;

(d) discriminating the type of abnormality to be a large-size impurity particle contained in the solidified shell when said first and second conditions are simultaneously detected.

3. A method of detecting breakout and inclusion abnormalities occurring in a solidified shell of a liquid metal being continuously cast within a mold comprising the steps of:

repeatedly measuring upper and lower temperatures, $T_U$ and $T_L$, respectively, at upper and lower portions of said mold with reference to the direction of flow of said shell in said mold;

detecting the occurrence of one of said abnormalities whenever $T_U$ is found to be less than or equal to $T_L$, said occurrence defined as a temperature inversion;

discriminating said abnormality as a breakout in the surface of said shell whenever the most recent measured upper and lower temperatures are a predetermined amount greater than the recent respective averages of said upper and lower temperatures; and discriminating said abnormality as an inclusion near the surface of said shell whenever the most recent measured upper and lower temperatures are a predetermined amount less than the recent respective averages of said upper and lower temperatures.

4. A method as in claim 3 further including the step of producing clock pulses which are used to determine intervals for measuring said upper and lower temperatures and for comparing said most recent measured upper and lower temperatures with said recent respective of said upper and lower averages.

5. A method as in claim 3 wherein said discriminating steps are limited to discriminating said abnormalities only after at least two successive occurrences of the most recent measured temperatures satisfying the stated respective conditions of said first and second mentioned discrimination steps.

6. A method as in claim 4 wherein said step of producing clock pulses includes the step of varying the period of said clock pulses in accordance with the casting speed of said solidified shell.

7. An apparatus for detecting abnormalities in a solidified shell of a liquid metal during continuous casting comprising:

mold means for continuously casting said liquid metal in a direction parallel with the force of gravity;

upper and lower temperature detection means for outputting respectively $T_U$ and $T_L$ temperatures indicative of the temperature of respective upper and lower portions of said mold means;

abnormality indication means for outputting a signal indicative of an abnormality in said solidified shell whenever said $T_U$ temperature is less than or equal to said $T_L$ temperature; and abnormality discrimination means, responsive to said abnormality signal, for periodically comparing respectively the most recent temperatures $T_U$ and $T_L$ with recent average temperatures thereof so as to discriminate the occurrence of a breakout abnormality whenever said most recent $T_U$ or $T_L$ temperature is significantly higher than its respective said recent average temperature and to discriminate the occurrence of an inclusion abnormality whenever said most recent $T_U$ or $T_L$ temperature is significantly lower than its respective said record average temperature, wherein said breakout abnormality constitutes an opening in the surface of said solidified shell and said inclusion abnormality constitutes an included non-metal particle near the surface of said solidified shell.

* * * * *